United States Patent [19]

Cotta

[11] Patent Number: 4,821,941

[45] Date of Patent: Apr. 18, 1989

[54] POWER REGULATOR FOR A PNEUMATIC FASTENER DRIVING TOOL

[75] Inventor: Gilbert A. Cotta, Cincinnati, Ohio

[73] Assignee: Senco Products, Inc., Cincinnati, Ohio

[21] Appl. No.: 85,715

[22] Filed: Aug. 18, 1987

[51] Int. Cl.[4] ..... B25C 1/04

[52] U.S. Cl. ..... 227/130; 227/8

[58] Field of Search ..... 173/15, 115; 227/8, 227/142, 130; 83/530; 91/402, 417 A, 417 R

[56] References Cited

U.S. PATENT DOCUMENTS 2,914,033 11/1959 Powers et al. ..... 173/115 X 3,081,742 3/1963 Goldring et al. ..... 91/417 R X

*Primary Examiner*—Frank T. Yost

*Assistant Examiner*—James L. Wolfe

*Attorney, Agent, or Firm*—Frost & Jacobs

[57] ABSTRACT

A regulator for adjusting the amount of power generated by a pneumatic fastener driving tool of the type having a body connected to a source of air under pressure and containing a cylinder with a piston/driver assembly mounted therein and a main valve. The main valve is slidably supported above the cylinder on a centerpost affixed to a cap closing the top of that portion of the tool body surrounding the cylinder. The main valve is shiftable on the centerpost between a closed position engaging the upper end of the cylinder and shutting off the cylinder from the supply of air under pressure within the tool body and opening vent passages in the centerpost and cap to vent the cylinder volume above the piston to atmosphere, and an open position closing the vent passages and opening the upper end of the cylinder to air under pressure within the tool body to actuate the tool. The regulator comprises an adjustable stop mounted in the centerpost and extending thereabout. The stop is shiftable toward and away from the cylinder and determines the open position of the main valve and thus the size of the opening between the cylinder and the main valve, which determines the power generated by the tool. An adjustment screw is rotatively mounted in the cap, having a first end above the cap and provided with a knob and a second end threadedly engaged in the stop to shift the stop.

22 Claims, 6 Drawing Sheets

POWER REGULATOR FOR A PNEUMATIC FASTENER DRIVING TOOL

TECHNICAL FIELD

The invention relates to a regulator for adjusting the amount of power generated by a pneumatic fastener driving tool, and more particularly to such a power regulator constituting a part of the tool so that the tool operator can easily adjust the tool power by rotating a knob on the exterior of the tool.

BACKGROUND ART

Prior art workers have devised many types of pneumatic fastener driving tools for driving staples, headed and headless nails, clamp nails and the like. A pneumatic fastener driving tool of the type contemplated by the present invention generally comprises a body connected to a source of air under pressure. The body contains a cylinder provided with a piston/driver assembly. The cylinder is surmounted by a main valve. The main valve is shifted between a closed position engaging the upper end of the cylinder and shutting the cylinder off from the supply of air under pressure within the tool body, and an open position opening the upper end of the cylinder to air under pressure to actuate the tool.

Most prior art pneumatic fastener driving tools are intended to be connected to a source of fluid under pressure (generally air), at a certain level of supply pressure. This, in conjunction with the tool design configuration and parameters, determines the power generated by the tool. Thus, most prior art tools of this type generate a predetermined amount of power which is not adjustable. It is normally sufficient for the largest fastener to be driven by the tool, such power being the maximum amount generated by the tool.

Prior art workers have recognized, however, that under some circumstances it would be advantageous to be able to adjust the power generated by a pneumatic fastener driving tool, depending upon the nature of the fastener, the fastener size, the nature of the workpiece into which the fastener is to be driven, and the desired depth of the fastener in the workpiece. In instances where power adjustment was required or desired, the most common prior art approach was to provide an air pressure regulator in the line to the source of air under pressure. An air pressure regulator has the net effect of changing tool output power. Unfortunately, by virtue of its weight and complexity, an air pressure regulator cannot conveniently be designed as part of the tool, or be located close to the tool.

Another approach for power regulation is taught in U.S. Pat. No. 4,523,646. This patent is directed to a vented pneumatic fastener driving tool. In such a tool, air in the cylinder beneath the piston/driver assembly is vented to atmosphere during the drive stroke. This patent teaches the provision of a choke for regulating the flow of air beneath the piston/driver assembly to atmosphere during a drive stroke. This approach has certain drawbacks. In essence, this approach controls the resistance to the drive stroke. Since the resistance is a fraction of the power generated, this approach does not give a wide variation of power regulation. Furthermore, this approach is restricted to use on the vented type of pneumatic fastener driving tool.

In a pneumatic fastener driving tool, the size of the opening between the cylinder and the main valve is a very critical parameter in generating tool power. Reducing the opening results in less power for a given tool design configuration and for a given level of supply pressure. Enlarging the opening increases the power to its maximum level. The highest power level is limited by the well established principle of critical pressure ratio or sonic velocity through an orifice. The present invention is based upon the discovery that if the opening between the cylinder and the main valve, when the main valve is in its open position, can be adjusted by the tool operator by means accessible on the tool, a control of the amount of power output can be achieved. The means for accomplishing this can be built into the tool and will add only minimally to the weight of the tool depending on the regulator design and the materials used. The cost of the regulator of the present invention is a fraction of the cost of a good air pressure regulator. Furthermore, the regulator comprises a part of the tool and is readily available to the operator at any time. The amount of power can be adjusted by simply rotating a knob located on the top of the tool. Rotating the knob in one direction increases the tool power. Rotating the knob in the opposite direction decreases the tool power. Therefore, a power adjustment can be readily made by the operator at any time, depending upon the nature of the fasteners, the size of the fasteners, the nature of the workpiece, the depth to which the fastener is to be driven in the workpiece, and the like. The power regulator of the present invention is applicable to vented and non-vented tools.

DISCLOSURE OF THE INVENTION

According to the invention there is provided a regulator for adjusting the amount of power generated by a pneumatic fastener driving tool. The tool is of the type having a body connected to a source of air under pressure. The body contains a cylinder provided with a piston/driver assembly. The cylinder is surmounted by a main valve. The main valve is capable of shifting axially of the cylinder and toward and away from the cylinder between a closed and an open position. In its closed position, the main valve engages the upper end of the cylinder, closing it off from the air under pressure within the tool body. At the same time, when in its closed position, the main valve opens vent passages leading to atmosphere, thus venting to atmosphere that portion of the cylinder between the piston/driver assembly and the main valve. In its open position, the main valve is spaced from the upper end of the cylinder and closes off the aforementioned vent passages. When the main cylinder is in its open position, air under pressure enters the top of the cylinder and drives the piston/driver assembly through a work stroke. Means for shifting the main valve between its open and closed positions are well known in art and do not constitute a part of the present invention.

The regulator of the present invention comprises an adjustable stop mounted in the tool housing above the main valve. The stop is shiftable toward and away from the main valve, and determines the open position of the main valve. As a consequence, the stop also varies the size of the opening between the cylinder and the main valve which, in turn, determines the power generated by the tool. The stop is threadedly engaged by a bolt rotatively mounted in the cap of the tool housing. The free end of the bolt, located exteriorly of the housing, is provided with a manually actuable knob. Rotation of the knob in one direction will advance the stop toward the main valve, thus making the built-in opening between the cylinder and the main valve smaller when the main valve is in its open position. Rotating the knob in the opposite direction will shift the stop away from the main valve, thus making,,the built-in opening between the cylinder and the main valve larger, when the main valve is in its open position.

DETAILED DESCRIPTION OF THE INVENTION

Figure 1:
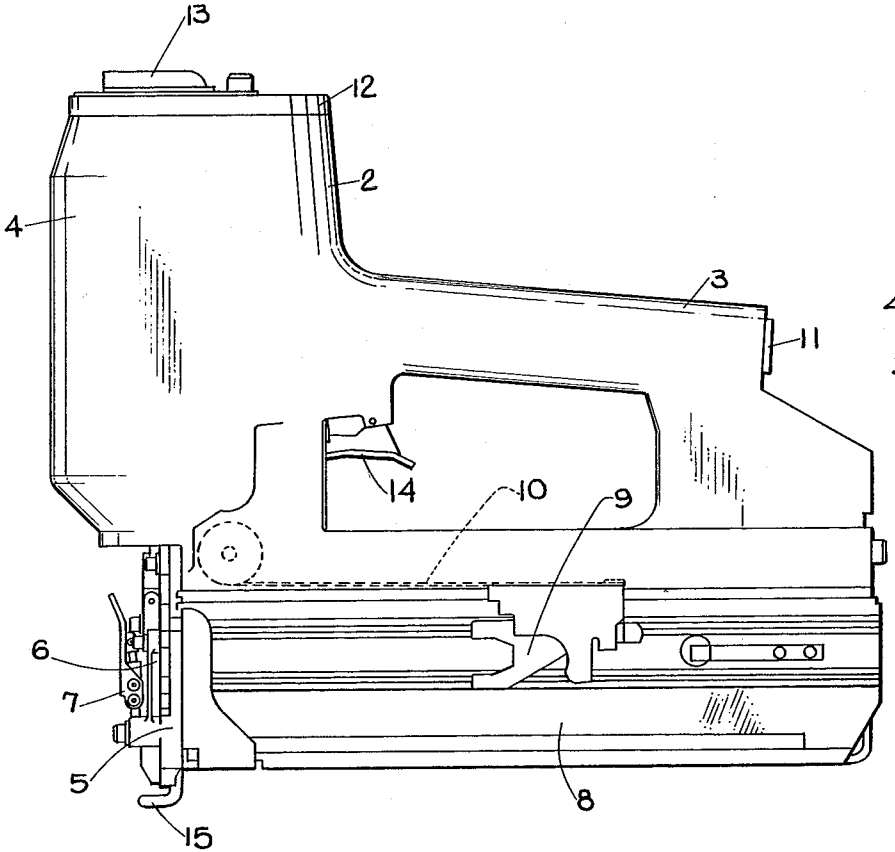
FIG. 1 PRIOR ART
FIG. 1 is a side elevational view of an exemplary prior art pneumatic fastener driving tool to which the teachings of the present invention may be applied.

Reference is first made to FIG. 1 wherein a typical pneumatically actuated fastener driving tool is generally indicated at 1. For purposes of an exemplary showing, the pneumatic fastener driving tool 1 is illustrated as a staple driving tool of the general type described in U.S. Pat. No. 4,165,676. Basically, the tool 1 has a body 2. The body 2 comprises a handle portion 3 and a main portion 4. The main portion 4 contains a cylinder provided with a piston/driver assembly, all as is well known in the art.

Below the main body portion 4 there is a guide body 5. The guide body 5 provides a drive track for the driver portion of the piston/driver assembly and for the staple being driven thereby. The guide body may have a front gate 6 by which access may be gained to the drive track in case a staple becomes jammed therein. The gate 6 is normally maintained in closed position by a latch mechanism 7.

The lowermost portion of the body 2 supports a magazine 8 adapted to receive a stick of staples. The forward end of magazine 8 is located adjacent guide body 5 and communicates with the drive track therein. A feeder shoe mechanism 9, again well known in the art, constantly urges the stick of staples toward guide body 5, locating the forwardmost staple of the stick in the guide body drive track, in position to be driven into a workpiece. The feeder shoe mechanism 9 is constantly urged forwardly by a spring mechanism, shown at 10 in broken lines.

The body 2 of tool 1 is provided with a fitting 11 adapted to connect with a hose, not shown, leading to a source of fluid under pressure. Most commonly, air under pressure is used.

The upper part of the main body portion 4 is closed by a cap 12, which cap may be provided with vent means 13. As will be apparent hereinafter, the cylinder (not shown) within the main body portion 4 is surmounted by a main valve (not shown). The main valve is shiftable vertically, as viewed in FIG. 1, between a closed position and an open position. In its closed position, the main valve engages the upper end of the cylinder and shuts it off from the pressurized air within body 2. In its open position, air under pressure is allowed to enter the top of the cylinder forcing the piston/driver assembly downwardly (as viewed in FIG. 1) through a drive stroke, driving a staple into a workpiece. In a tool of the type illustrated in FIG. 1, the power generated by the tool is not variable and is determined by the design parameters of the tool including such factors as the size of the opening between the main valve and the top of the cylinder when the main valve is in its open position, the level of supply pressure, and the like.

Shifting of the main valve between its open and closed positions is controlled by a remote valve (not shown) as is well known in the art. The remote valve is actuated by a trigger 14. Finally, the tool may be provided with a workpiece responsive trip 15. The workpiece responsive trip serves as a safety. The workpiece responsive trip 15 normally disables trigger 14. However, when the guide body 5 of the tool 1 is pressed against the workpiece and the workpiece responsive trip is shifted upwardly (as viewed in FIG. 1) it enables trigger 14 so that the operator can, through the agency of trigger 14, actuate the remote valve. This in turn shifts the main valve to its open position, causing the piston/driver assembly to perform a work stroke.

Figure 2:
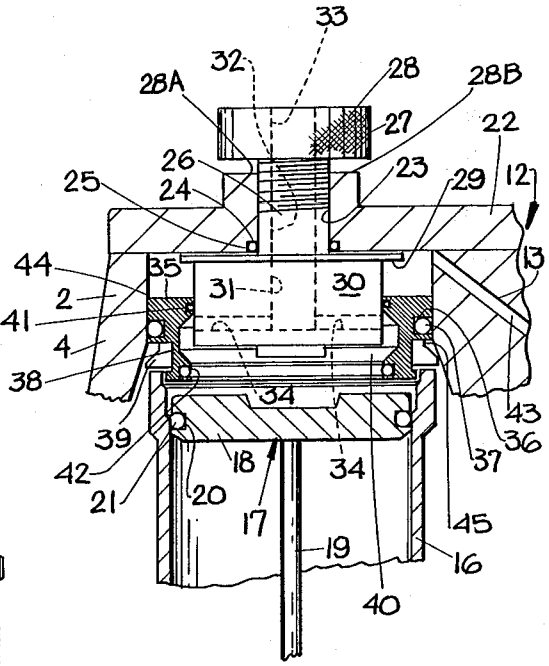
FIG. 2 is a fragmentary cross sectional view illustrating a simplified embodiment of the present invention.

Reference is now made to FIG. 2 wherein a simple and basic embodiment of the present invention, as applied to a tool of the type illustrated in FIG. 1, is shown. In FIG. 2, the main portion 4 of the tool body 2 is fragmentarily shown. Within the main body portion 4, the upper portion of the tool cylinder is shown at 16. Within cylinder 16 the piston/driver assembly is generally indicated at 17. The assembly 17 comprises a piston 18 and a driver 19. The piston 18 is provided with a peripheral groove 20 containing an O-ring 21 making a seal with the inside surface of cylinder 16.

The upper part of main body portion 4 is closed by a cap 22. While the cap 22 differs in construction from cap 12 of FIG. 1, it is the basic equivalent thereof.

The cap 22 has a central bore 23. The bore 23 is internally threaded and terminates at its lower end in an annular notch 24 in which an O-ring 25 is seated. The internally threaded bore 23 is adapted to accommodate an adjustment screw 26. O-ring 25 makes a fluid-tight seal with adjustment screw 26.

The upper end of adjustment screw 26 is provided with a knob 27 non-rotatively affixed thereto by any suitable means. The knob 27 may be knurled, as is indicated at 28, so that it may be more easily manually operated. The lower end of adjustment screw 26, as viewed in FIG. 2, is affixed to a stop ring 29. The stop ring, in turn, is fastened to (or constitutes an integral part of) a cylindrical centerpost 30. Centerpost 30 has an axial passage or bore formed therein. Adjustment screw 26 and knob 27 have additional bores 32 and 33, respectively, both coaxial with bore 31. The centerpost 30 also has a plurality of radial bores, two of which are shown at 34, which extend from axial bore 31 through the periphery of the centerpost. The bores 31 through 34 form a vent passage, which will be explained hereinafter.

The main valve 35 is shown in its closed position. Main valve 35 comprises an annular ring-like member. On its exterior surface, the main valve 35 has a groove 36 adapted to receive an O-ring 37. The O-ring 37 makes an airtight seal with the inside surface of main body portion 4. The lower portion of the exterior surface of main valve 35 is provided with a notch 38 adapted to receive a sealing gasket 39. As is shown in FIG. 2, when main valve 35 is in its closed position, the sealing gasket 39 seats on the upper edge of cylinder 16, forming an airtight seal therewith.

The main valve 35, being cylindrical in configuration, has a central bore 40. The uppermost and lowermost portions of central bore 40, as viewed in FIG. 2, have an internal diameter substantially equal to the external diameter of centerpost 30 and are provided with grooves containing O-rings 41 and 42, respectively. O-rings 41 and 42 are both capable of making airtight seals with the peripheral surface of centerpost 30. As will be apparent from FIG. 2, the central portion of bore 40, between O-rings 41 and 42, is of an internal diameter greater than the external diameter of centerpost 30.

The remote valve (not shown) communicates through passage 43 in housing main portion 4 with the annular volume defined by the inside surface of main body portion 4, the bottom surface of cap 22, the peripheral surface of centerpost 30 and the upper surface 44 of main valve 35. The annular surface 45 of the main valve, adjacent sealing gasket 39, is also exposed to air under pressure. Since the area of main valve surface 45 is far less than the area of main valve top surface 44, the air under pressure acting upon top surface 44 will assure that sealing gasket 39 is firmly seated against the upper edge of cylinder 16, forming an airtight seal therewith. At the same time, that volume of cylinder 16 above piston 18 is connected to atmosphere through vent passage bores 31 through 34.

When the tool trigger is actuated by the operator, resulting in actuation of the remote valve (not shown), the remote valve will connect the volume above main valve 35, by means of passage 43, to atmosphere. Under these circumstances, air under pressure operating against the annular surface 45 of the main valve will cause the main valve to shift upwardly until it is stopped by stop plate 29. This opens the upper end of cylinder 16, enabling the air under pressure to drive the piston/-driver assembly 17 through a work stroke.

In FIG. 2, stop plate 29 and centerpost 30 are shown in their uppermost positions so that when the main valve shifts to its open position, it will abut stop plate 29, achieving its maximum open position. Under these circumstances, the piston/driver assembly 17 will be driven through a work stroke at maximum tool power.

By rotating knob 27 in one direction, the stop plate 29 and centerpost 30 will be shifted downwardly, as viewed in FIG. 2. The distance in which stop plate 29 shifts downwardly is limited to a fraction of the maximum amount main valve 35 travels, the shifting limit of stop plate 29 being fixed by the abutments of surface 28A of knob 27 with surface 28B of cap 12. When stop plate 29 reaches the lowest position, it allows main valve 35 to have an opening sufficient to generate the minimum power generated by the action of air under pressure on assembly 17. When the stop plate 29 and centerpost 30 are shifted downwardly from their positions shown in FIG. 2, it will be understood that the stop plate 29 will reduce the amount by which the main valve 35 can shift upwardly, thereby reducing the opening between sealing gasket 39 and the upper end of cylinder 16. This, in turn, reduces the power with which the piston/ driver assembly 17 is driven through its work stroke.

Rotating knob 27 in the opposite direction will again raise stop plate 29 and centerpost 30 toward the position shown in FIG. 2. It will be apparent that stop plate 29 can readily be manually shifted through a range of positions enabling the power of the tool to be adjusted through a range. It will be understood by one skilled in the art that when the operator releases the tool trigger, the remote value (not shown) will return to is normal state, introducing air under pressure above main valve 35 via passage 43, causing the main valve to close. It will be evident that the structure just described provides a simple, inexpensive power regulator adding very little weight to the tool and constituting a part of the tool. The regulator knob 27 is within easy reach at all times. Indicia may be applied to knob 27, cap 22, or both, indicating various position settings of stop plate 29 and centerpost 30, equivalent to various power settings.

Figure 4:
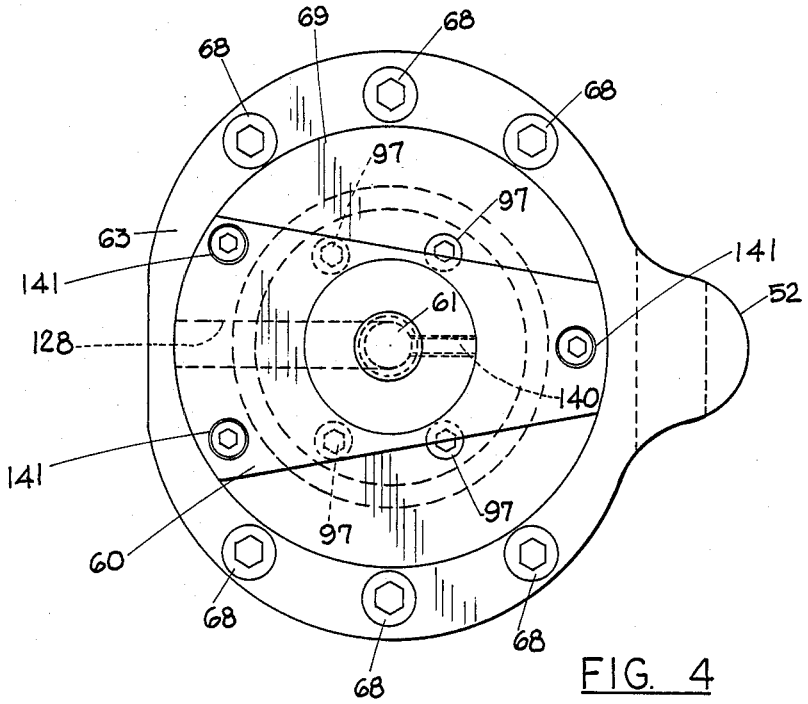
FIG. 4 is a plan view of the structure of FIG. 3.
Figure 3:
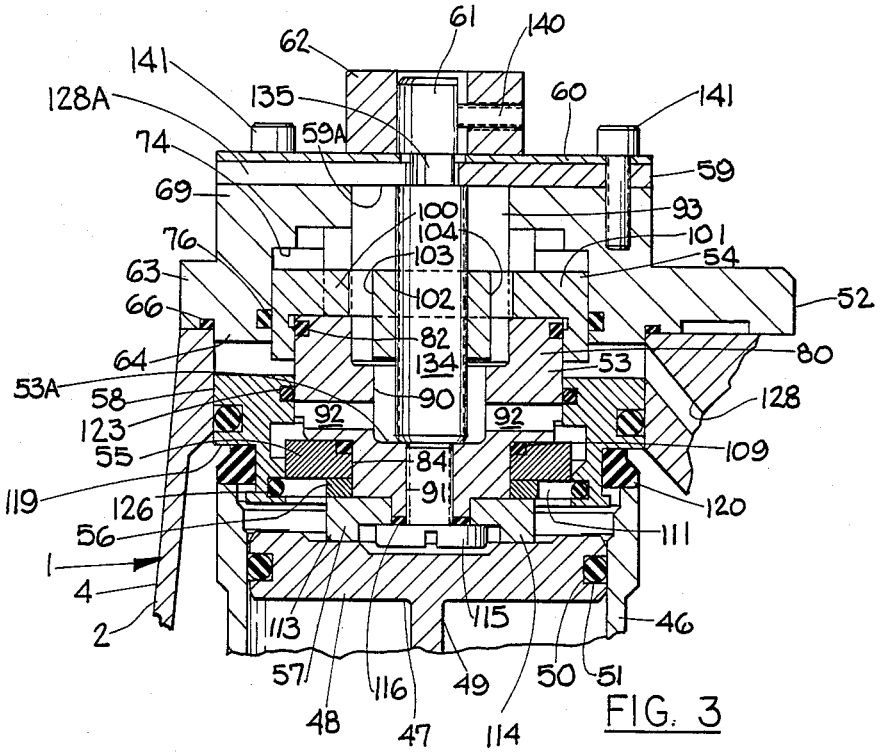
FIG. 3 is a fragmentary cross sectional view illustrating the regulator of the present invention as applied to the prior art tool of FIG. 1.

FIGS. 4 through 21 illustrate an actual embodiment of the present invention as applied to the fastener driving tool 1 of FIG. 1. In all of these figures, like parts have been given like index numerals. Turning first to FIGS. 3 and 4, the upper part of the main portion 4 of body 2 of tool 1 is fragmentarily shown. The tool cylinder, equivalent to cylinder 16 of FIG. 2, is indicated at 46. The cylinder 46 contains a piston/driver assembly 47 (equivalent to piston/cylinder assembly 17 of FIG. 2), comprising piston 48 and driver 49. Piston 48 is provided with a peripheral groove 50 containing an O-ring 51 for making an airtight seal with the inside surface of cylinder 46.

FIG. 3 illustrates the main components of the power regulator of the present invention. These components comprise a cap 52, a centerpost 53, an adjustable stop 54, a first valve spacer 55, a second valve spacer 56, a piston bumper stop 57, a main valve 58, a screw retainer plate 59, an air deflector cover 60, an adjustment screw 61 and an adjustment screw knob 62. Each of these elements will be described in turn.

Figure 5:
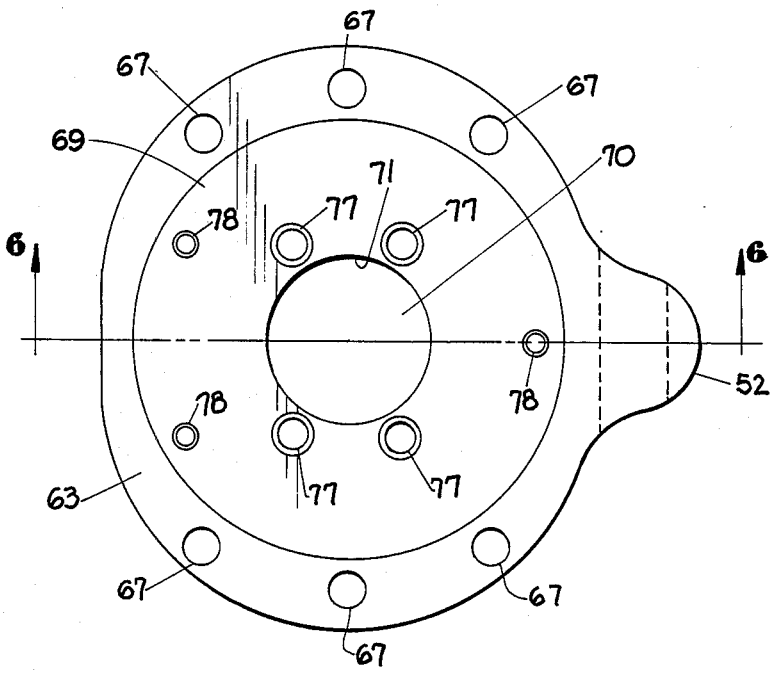
FIG. 5 is a plan view of the cap of the present invention.
Figure 6:
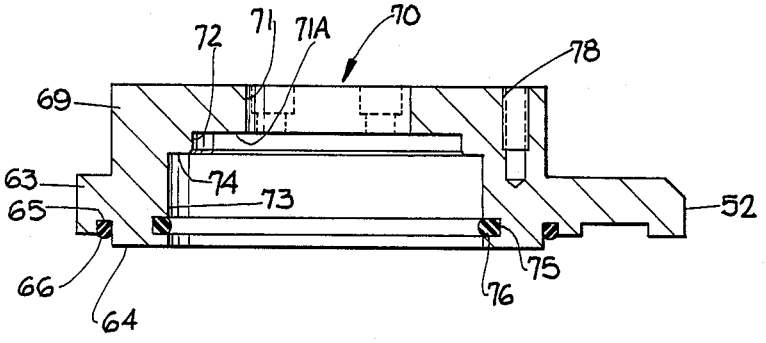
FIG. 6 is a cross sectional view taken along section line 6—6 of FIG. 5.

Reference is now made to FIGS. 5 and 6, wherein the cap 52 is illustrated. The cap 52 has a main substantially planar body portion 63. On its underside, there is a cylindrical extension 64 surrounded by a groove 65 containing an O-ring 66. The body portion 63 is provided with a plurality of perforations 67 (see FIG. 5).

As will be apparent from FIG. 3, the body portion 63 of cap 52 is adapted to rest upon and close the upper part of main tool body portion 4. The downwardly depending cylindrical portion 64 of the cap is received within the upper end of main tool body portion 4, and O-ring 66 makes an airtight seal therewith. The holes 67 of cap 52 receive machine screws which threadedly engage corresponding holes (not shown) in the upper surface of the tool main body portion 4. These machine screws are shown at 68 in FIG. 4. Machine screw 68 firmly attaches cap 52 to the upper end of the tool main body portion 4.

Returning to FIGS. 5 and 6, the upper surface of the planar portion 63 of cap 52 is provided with an upstanding cylindrical portion 69. As is most clear from FIG. 6, the upstanding central portion 69, the substantially planar portion 63 and the downwardly depending cylindrical body portion 64 have a central bore, generally indicated at 70 formed therein. The bore 70 has an uppermost portion 71. The portion 71 is followed by a second portion 72 of larger diameter and forming a shoulder 71A therebetween. Bore portion 72 is followed by bore portion 73 of somewhat larger diameter forming a shoulder 74 therebetween. Bore portion 73 has an annular groove 75 formed in its surface to receive an O-ring 76.

The cap 52 is completed by the provision of four countersunk holes 77 and three threaded bores 78, all formed in the upstanding cylindrical portion 69. The purpose of these bores will be apparent hereinafter.

Figure 7:
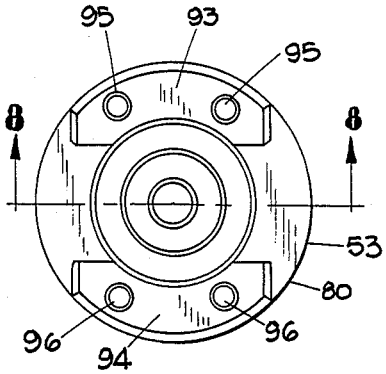
FIG. 7 is a plan view of the center post of the present invention.
Figure 8:
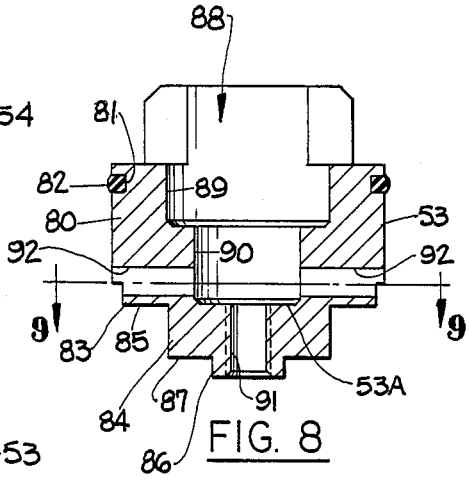
FIG. 8 is a cross sectional view taken along section line 8—8 of FIG. 7.
Figure 9:
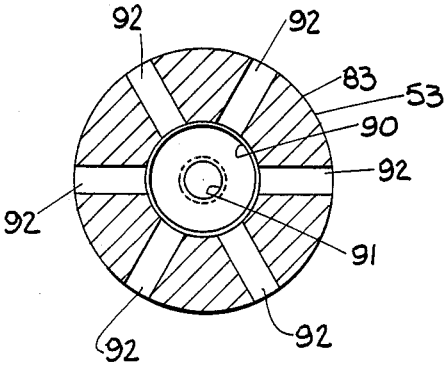
FIG. 9 is a cross sectional view taken along section line 9—9 of FIG. 8.

Reference is now made to FIGS. 7, 8 and 9 wherein centerpost 53 is illustrated. Centerpost 53 has a main cylindrical body portion 80 provided near its upper end with an annular groove 81 to receive an O-ring 82. The main body portion 80 is followed by a body portion 83 of slightly less diameter. Body portion 83, in turn, is followed by a third body portion 84, again of slightly lesser diameter, forming a shoulder 85 between body portions 83 and 84. The centerpost terminates in a lowermost body portion 86 of lesser diameter than body portion 84, thereby forming a shoulder 87 therebetween.

Centerpost 53 has an axial bore formed therein, and generally indicated at 88. The axial bore 88 is made up of an upper portion 89, an intermediate portion 90 and a lower portion 91. Bore portion 90 is of lesser diameter than bore portion 89. Bore portion 91 is of lesser diameter than bore portion 90 and is internally threaded. A plurality of a radial bores 92 (see FIG. 9), the axes of which are coplanar, extend from bore portion 90 through the peripheries of adjacent parts of body portions 80 and 83.

The main body portion 80 is provided with a pair of upstanding ears 93 and 94. The ears 93 and 94 are diametrically opposed and identical. The exterior surfaces of ears 93 and 94 are arcuate and constitute a continuation of the peripheral surface of main body portion 80. The interior surfaces of ears 93 and 94 are also arcuate, constituting continuations of the cylindrical interior surface of bore portion 89. Ear 93 is provided on its upper surface with a pair of threaded bores 95. Ear 94 is similarly provided with a pair of threaded bores 96. As will be evident from FIG. 3, the centerpost 53 is affixed to cap 52 with the upper surfaces of ears 93 and 94 abutting the cap inner shoulder 71A. Centerpost ear bores 95 and 96 correspond to cap bores 77 and the centerpost is affixed to the cap by machine screws 97 (see FIG. 4) located in cap bores 77 and threadedly engaged in centerpost ear bores 95 and 96.

Figure 10:
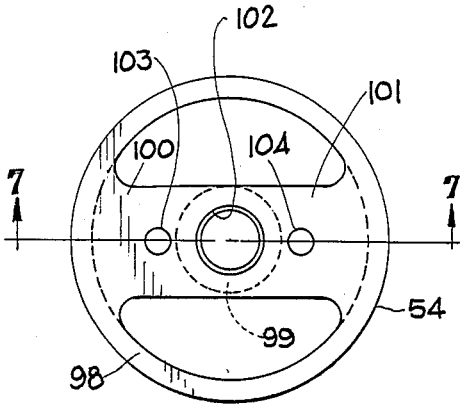
FIG. 10 is a plan view of the stop of the present invention.
Figure 11:
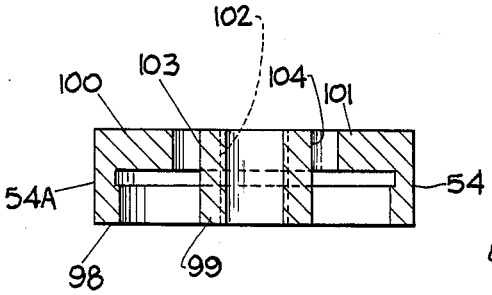
FIG. 11 is a cross sectional view taken along section line 7—7 of FIG. 10.

Reference is now made to FIGS. 10 and 11 wherein the adjustable stop 54 is shown. The adjustable stop 54 comprises an annular rim-like body 98 and a central hub 99. The central hub 99 and the annular rim-like body 98 are joined together by diammetrically extending webs 100 and 101. The hub 99 has a threaded axial bore 102. The webs 100 and 101 are provided with bores 103 and 104, but may include a plurality of other bores. The bores 103 and 104 serve the purpose of enlarging the exhaust of air return to speed up returning the piston/-driver assembly to its pre-fire condition.

Referring to FIGS. 3 and 7, it will be noted that the adjustable stop 54 is mounted in centerpost 53. To this end, the hub portion 99 of the adjustable stop 54 is received within bore 88 of centerpost 53. The webs 100 and 101 are slidably received between centerpost ears 93 and 94. The rim-like body 98 of adjustable stop 54 has an external diameter such as to be slidably received in the bore portion 73 of cap 52. The cap O-ring 76 makes an airtight seal with the exterior surface of the rim-like body portion 98 of adjustable slide 54. The interior surface of the rim-like body portion 98 of adjustable stop 54 is of a diameter such as to be slidable with respect to the outer surface of the main body portion 80 of centerpost 53. The centerpost O-ring 82 makes an airtight seal with the inside surface of the rim-like body portion 98 of adjustable stop 54.

From the above description it will be apparent that adjustable stop 54 is shiftable vertically with respect to cap 52 and centerpost 53. Adjustable stop 54, however, is not rotatable with respect to centerpost 53 and cap 52 by virtue of the fact that its webs 100 and 101 are located between centerpost ears 93 and 94.

Figure 13:
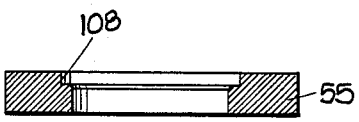
FIG. 13 is a cross sectional view taken along section line 13—13 of FIG. 12.
Figure 12:
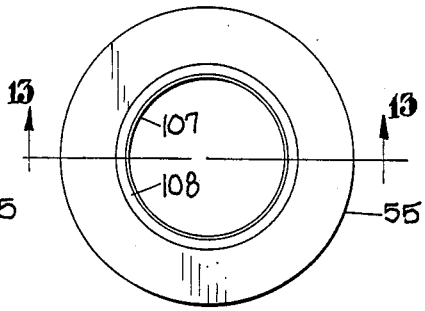
FIG. 12 is a plan view of a first valve spacer of the present invention.

FIGS. 12 and 13 illustrate the first valve spacer 55. Valve spacer 55 comprises a disk-like annular member having a central bore 107. At its upper end, the bore 107 is slightly enlarged to form an annular notch 108. The purpose of annular notch 108 will be apparent hereinafter. Referring to FIGS. 3, 8, 12 and 13, it will be noted that the central bore 107 of first valve spacer 55 is of a diameter substantially equal to the external diameter of centerpost body portion 84 and is receivable thereon. The first spacer annular notch 108 receives an O-ring 109 forming an airtight seal between the first valve spacer 55 and the peripheral surface of centerpost body portion 84, as well as with centerpost shoulder 85.

Figure 15:
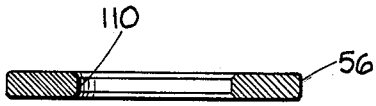
FIG. 15 is a cross sectional view taken along section line 15—15 of FIG. 14.
Figure 14:
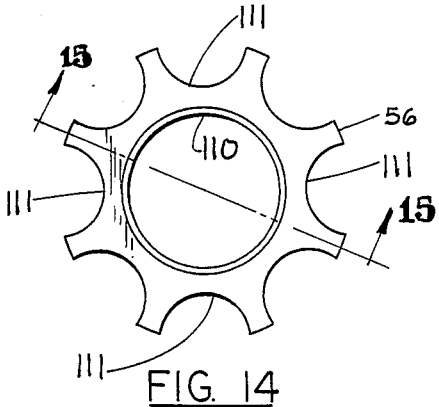
FIG. 14 is a plan view of a second valve spacer of the present invention.

FIGS. 14 and 15 illustrate the second valve spacer 56. The second valve spacer 56 comprises an annular member of uniform thickness having an exterior diameter substantially equivalent to that of first valve spacer 55. Second valve spacer 56 has a central bore 110 of the same diameter as the central bore 107 of the first valve spacer 55. Finally, the second valve spacer has a plurality of arcuate notches 111 formed in its periphery and equally spaced thereabout.

As will be evident from FIG. 3, the second spacer 56 is mounted on the body portion 84 of centerpost 53 directly beneath and abutting the first valve spacer 55.

Figure 16:
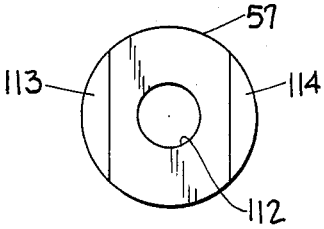
FIG. 16 is a bottom view of the bumper of the present invention.

FIG. 16 is a bottom view of the bumper stop 57. The bumper stop 57 comprises a disk-like member having a central bore 112. On its underside, bumper stop 57 has a pair of downwardly depending, diametrically opposed stops 113 and 114 terminating in coplanar horizontal surfaces, as viewed in FIG. 3.

Referring to FIG. 3, it will be noted that the bumper stop 57 is mounted on centerpost 53. The body portion 86 of centerpost 53 is received within the bumper stop bore 112 and the bumper stop is held in place against centerpost shoulder 87 by a screw 115 threadedly engaged in centerpost bore portion 91. It will be noted that an O-ring 116 is captively mounted between bumper stop 57, centerpost body portion 86 and screw 115, forming an airtight seal between these parts.

Bumper stop 57 serves a dual purpose. First of all, it holds the first valve spacer 55 and the second valve spacer 56 in position on centerpost 53. Secondly, it serves as a protective stop, determining the uppermost position of the piston/driver assembly 47.

Figure 17:
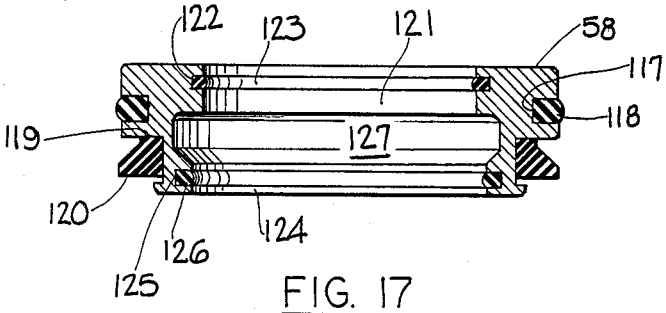
FIG. 17 is a transverse, cross sectional elevational view of the main valve.

Main valve 58 is illustrated in FIG. 17. Main valve 58 comprises an annular ring-like structure. On its upper peripheral surface, the main valve has a groove 117 accommodating an O-ring 118. On its lower peripheral surface, the main valve has an annular notch 119 in which a sealing gasket 120 is mounted. On its inside surface, the annular main valve has a first surface portion 121, provided with a groove 122 in which an O-ring 123 is mounted. The inner surface has a second surface portion 124 provided with a groove 125 supporting an O-ring 126. The surfaces 121 and 124 are joined by an intermediate surface 127 which is of larger diameter than either surface 121 or surface 124.

Turning again to FIG. 3, it will be noted that the internal diameter of inner surface 121 is substantially equivalent to the external diameter of centerpost body portion 80 and the main valve O-ring 123 sealingly engages the exterior surface main valve body portion 80. It will further be noted that the internal surface portion 124 of the main valve is of substantially the same internal diameter as the external diameter of first valve spacer 55 and second valve spacer 56 so that the exterior surfaces of these valve spaces can be engaged by main valve O-ring 126. The exterior diameter of the upper portion of main valve 58 has an outside diameter substantially equivalent to the inside diameter of the adjacent upper part of the tool main body portion 4 such that the main valve O-ring 118 makes an airtight seal therewith.

Figure 21:
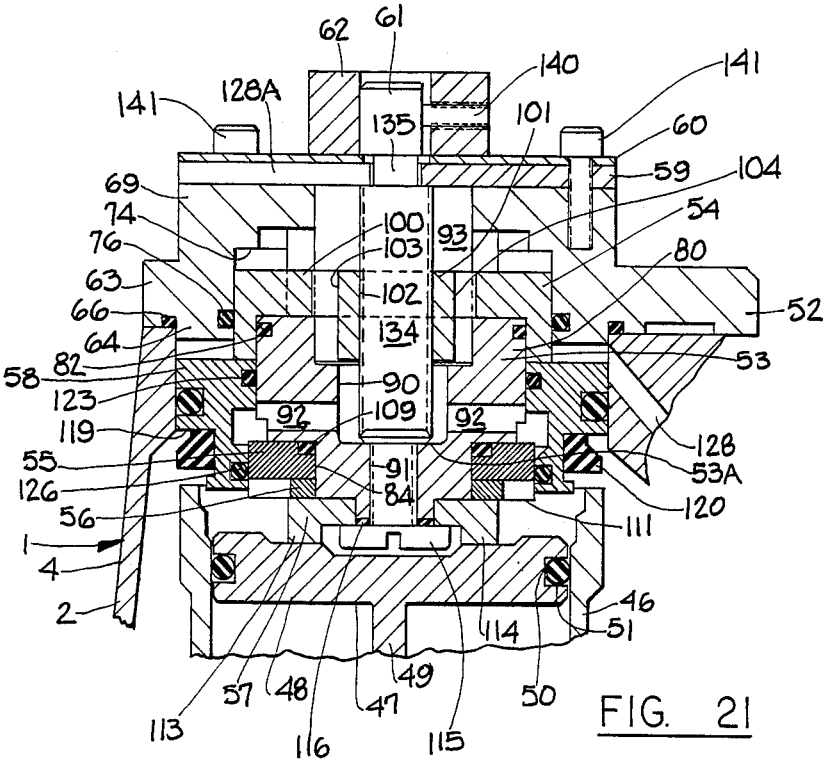
FIG. 21 is a fragmentary cross sectional view similar to FIG. 3, and illustrating the main valve in an adjusted open position.

As will be apparent hereinafter, the main valve is shiftable vertically, as viewed in FIGS. 3 and 21. In FIG. 21, the main valve is shown in an open position. In FIG. 3, the main valve is shown in its closed position. In its closed position, the sealing gasket 120 sealingly engages the upper edge of cylinder 46.

Figure 18:
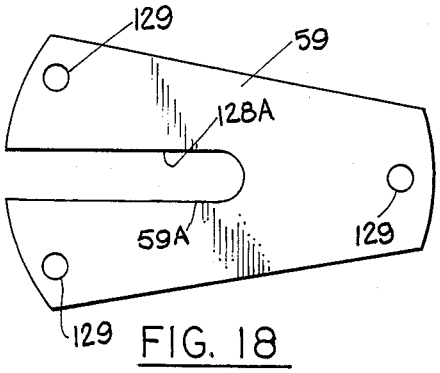
FIG. 18 is a plan view of the screw retainer plate.

Reference is next made to FIG. 18, which is a plan view of the screw retainer plate 59. The screw retainer plate is a relatively thick plate provided with a longitudinal notch 128A. The purpose of notch 128A will be apparent hereinafter. The screw retainer plate is also provided with a series of perforations 129 which correspond to the threaded bores 78 of cap 52 (see FIG. 5).

Figure 19:
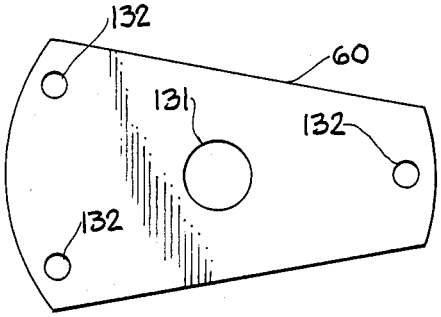
FIG. 19 is a plan view of the air deflector cover.
Figure 20:
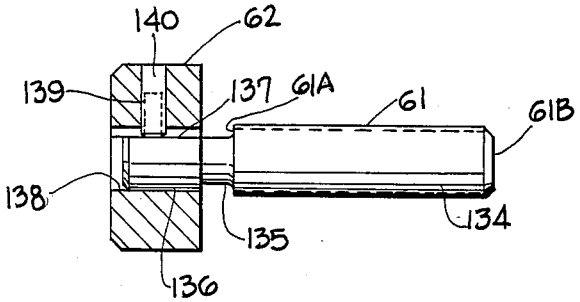
FIG. 20 is an elevational view, partly in cross section, illustrating the adjustment screw and its knob.

FIG. 19 illustrates the air deflector cover 60. This is a plate-like element having the same peripheral configuration as screw retaining plate 59. It will be noted that the air deflector cover 60 is thinner than the screw retainer plate 59. Air deflector cover 60 is provided with a central perforation 131, the purpose of which will be apparent hereinafter. It is also provided with a series of perforations 132 corresponding to the perforations 129 of screw retainer plate 59.

The final elements of the power regulator of the present invention comprise adjustment screw 61 and knob 62. These elements are illustrated in assembled condition in FIG. 20. Adjustment screw 61 has a main threaded body portion 134. The threaded body portion 134 is surmounted by a neck portion 135 of lesser diameter. The neck portion 135, in turn, is surmounted by a head portion 136 having approximately the same diameter as the main body portion 134. The head portion 136 has a flat 137 formed thereon.

The knob 62 has an axial bore 138 so sized as to receive the head portion 136 of adjustment screw 61. The knob 62 has a threaded transverse perforation 139 which extends from its periphery to the axial bore 138. Threaded bore 139 accommodates a set screw 140 which cooperates with the flat 137 on the adjustment screw head portion 136 to non-rotatively mount knob 62 thereon. Since knob 62 is intended to be manually rotated, its peripheral surface may be knurled or ribbed (not shown).

The assembly of the screw retaining plate 59, the air deflector cover 60, adjustment screw 61 and knob 62 is clearly shown in FIG. 3. The main threaded body portion 134 of adjustment screw 61 is threadedly engaged in the central bore 102 of adjustable stop 54. The lower end of the screw is received in bore portion 90 of centerpost 53.

The neck portion 135 of adjustment screw 61 is receivable in the longitudinal slot 128A of screw retainer plate 59. Slot 128A is so sized that the neck portion 135 of adjustment screw 61 is rotatable therein. It will be noted from FIG. 3 that the air deflector cover 60 is mounted above screw retainer plate 59. The axial movement of adjustment screw 61 is prevented by the friction forces of surface 54A of adjustable stop 54 against O-ring 76 and surface 73 of cap 52. It will be evident from FIG. 3, however, that by virtue of the length of main body 134, which is confined between surface 59A of plate 59 and surface 53A of centerpost 53, and the threaded engagement of the main body portion 134 of adjustment screw 61 in the threaded perforation 102 of adjustable stop 54, rotation of knob 62 in one direction will cause the adjustable stop 54 to shift downwardly, while rotation of adjustment knob 62 in the opposite direction will cause the adjustable stop 54 to shift upwardly, as viewed in FIG. 3. Air deflector cover 60 and screw retainer plate 59 are affixed to portion 69 of cap 52 by machine screws 141 passing through perforations 132 of air deflector cover 60, bores 129 of screw retainer plate 59 and threadedly engaged in bores 78 of cap 52.

The structure of the present invention having been described in detail, its operation can now be set forth. FIG. 3 illustrates main valve 58 in its normal, closed condition. This is the condition of the main valve which exists when the remote valve (not shown) is unactuated by trigger 14 (see FIG. 1). In its unactuated condition, the remote valve directs air under pressure through passage 128 (see FIG. 3) to the annular volume above main valve 58. At the same time, air under pressure within the body 2 of the tool 1 acts upon that portion of the main valve exterior notch 119 adjacent sealing gasket 120. Since the area of the upper surface of the main valve 58 is far greater than the exposed surface of main valve notch 119, the valve will be firmly held in its lowermost, closed position with sealing gasket 120 sealingly engaging the upper edge of cylinder 46.

When the main valve 58 is in its lowermost, closed position, that volume of cylinder 46 above piston 48 is vented to atmosphere. It will be noted that O-ring 126 of main valve 58 is sealingly engaged with the peripheral surface of second valve spacer 56. However, valve spacer 56 has the arcuate notches 111 formed i it, creating a passage thereby. It will further be noted that the O-ring 123 of main valve 119 is sealingly engaged with the main body portion 80 of centerpost 53, above the radial passages 92. Therefore, connection of the volume above piston 48 to atmosphere is made by means of the notches 111 in second valve spacer 56, the radial passages 92 in the centerpost, central bore portions 90 and 89 in the centerpost, and the longitudinal notch 128 in the screw retainer plate 59. The air deflector cover 60 makes the longitudinal slot 128A in screw retainer plate 59 a passage, directed to the front of the tool.

When the remote valve (not shown) is actuated by trigger 14 (see FIG. 1), air under pressure is shut off from passage 128 and passage 128 is opened to atmosphere through the trigger design geometry. In the absence of air under pressure above main valve 58, the air under pressure below the main valve will cause the main valve to shift upwardly to its open position. In its open position, the sealing gasket 120 is spaced from the upper edge of cylinder 46 forming an annular opening therebetween. This permits the air under pressure to enter the cylinder forcing the piston/driver assembly through a work stroke.

As is further apparent from FIG. 21, when the main cylinder shifts to its open position, the O-ring 126 of main valve 58 engages the periphery of the first valve spacer forming an airtight seal therewith. Thus, that portion of the cylinder above piston 48 is no longer vented to atmosphere.

In FIGS. 3 and 21, the adjustable stop 54 is shown in its lowermost position, as determined by abutment of the adjustable stop webs 100 and 101 against the upper surface of the main body portion 80 of centerpost 53. When the main valve is in its open position, its upper surface abuts the lower surface of adjustable stop 54, as shown in FIG. 21. Since the adjustable stop 54 is in its lowermost position, the annular opening between sealing gasket 120 and the upper edge of cylinder 46 is at its minimum, and the tool will operate at lowest power. It will be evident, however, from FIGS. 3 and 21 that if knob 62 were rotated in the proper direction, the adjustable stop 54 would shift vertically upwardly, as viewed in those figures, until it reached its maximum upward position wherein the top surface of adjustable stop 54 abuts the shoulder 74 of cap 52. When the adjustable stop 54 is in this position, and the main valve 58 is opened until it abuts the lower end of adjustable stop 54, the annular opening between sealing gasket 120 and the upper edge of piston 46 will be at its maximum, and the tool will function at maximum power. It will be understood that through the agency of knob 62, the adjustable stop can be located at any position between its lowermost and uppermost positions, thereby enabling a range of power generated by the tool 1. To assist the operator in this, indicia (not shown) may be applied to knob 62, air deflector cover 60, or both. It will be immediately evident that the power regulator of the present invention constitutes an integral part of the tool, is readily adjustable at any time by the operator, and will add minimal weight to the tool.

Modifications may be made in the invention without departing from the spirit of it. In the specification and claims, words such as "upwardly", "downwardly", "vertical", and the like are used for purposes of clarity in conjunction with the figures. It will be understood by one skilled in the art that in use, the tool may be held in any orientation.

What is claimed is:

1. A regulator for adjusting the amount of power generated by a pneumatic fastener driving tool of the type having a body connected to a source of air under pressure, a cylinder within said body having an open upper end, a piston/driver assembly in said cylinder, a main valve within said body located above said upper end of said cylinder and shiftable axially of said cylinder between a closed position engaging said upper end of said cylinder and sealing said cylinder from said air under pressure and an open position spaced from said upper end of said cylinder defining an annular opening between said main valve and said upper end of said cylinder allowing said air under pressure to enter said cylinder and shift said piston/driver assembly through a work stroke, and means to shift said main valve between said open and closed positions, said regulator comprising a stop means mounted within said body above said main valve and abuttable by said main valve to determine said open position of said main valve, means to shift said stop means toward and away from said upper cylinder end to adjust said open position of said main valve to thereby adjust the size of said annular opening and said power of said tool, a portion of said shifting means extending through said body, manual actuating means attached to said shifting means exteriorly of said body.

2. The regulator claimed in claim 1 wherein said body has an opening therein above said cylinder, said main valve and said stop means, said body including a cap closing said opening, said shifting means extending through said cap.

3. The regulator claimed in claim 2 including a threaded perforation in said cap coaxial with said cylinder, said means is shifted said stop means comprising an adjustment screw threadedly engaged in said cap perforation, said cap perforation terminating at its lowermost end in an annular notch, an O-ring in said notch sealingly engaged between said cap and said adjustment screw.

4. The regulator claimed in claim 3, said adjustment screw having a first end extending above and exteriorly of said cap and a second end, wherein a manually actuable knob is mounted on said adjustment screw first end and a cylindrical centerpost surmounted by a circular stop ring of greater diameter than said centerpost is affixed to said second end of said screw beneath said cap, said stop ring/centerpost assembly comprising said stop means and being coaxial with said cylinder, said stop ring/centerpost assembly having a top and a bottom.

5. The regulator claimed in claim 4, wherein said main valve comprises an annular ring-like member, said main valve having an internal diameter substantially equal to the diameter of said centerpost and being slidably and guidably mounted on said centerpost, wherein means on said main valve forms an air-tight seal with said centerpost.

6. The regulator claimed in claim 5, wherein said housing adjacent said main valve has a cylindrical internal surface of a diameter corresponding to the external diameter of said main valve, said main valve peripheral surface having a sliding fit with said adjacent housing cylindrical internal surface and having a groove containing an O-ring making an air-tight seal therewith.

7. The regulator claimed in claim 6, said main valve having an annular notch formed in its periphery at the lowermost edge thereof, wherein a sealing gasket is mounted in said notch, said sealing gasket engaging said upper end of said cylinder when said main valve is in said closed position and said main valve abutting said stop ring when in its open position, whereby said stop ring/centerpost assembly is shiftable toward and away from said cylinder by rotation of said adjustment screw in opposite directions to adjust said annular opening and said tool power.

8. The regulator claimed in claim 7 including passage means connecting that portion of said cylinder above said piston/driver assembly to atmosphere, said main valve in said open position closing said passage means, said main valve in said closed position opening said passage means.

9. The regulator claimed in claim 7 including an axial bore in said adjustment screw and an axial bore extending from the top of said stop ring/centerpost assembly to a point short of the bottom of said assembly, a plurality of radial bores in said stop ring/centerpost assembly extending from the periphery thereof to said axial bore therein, said axial and radial bores comprising a vent passage from that portion of said cylinder above said piston/driver assembly to atmosphere, said main valve having a groove formed in the upper portion of its inner surface containing a first O-ring making an air-tight seal with the periphery of said centerpost above said radial passages when said main valve is in both its open and closed positions, said main valve having a groove formed in the lower portion of its inner surface containing an O-ring making an air-tight seal with the periphery of said centerpost below said radial passages therein only when said main valve is in its open position whereby when said main valve is in its closed position that portion of said cylinder above said piston/driver is vented to atmosphere, said vent passages being closed when said main valve is in its open position.

10. The regulator claimed in claim 2 including a bore in said cap coaxial with said cylinder, said cap bore having an uppermost portion, an intermediate portion of greater diameter forming a first shoulder between said uppermost and intermediate portions, a lowermost portion of yet greater diameter forming a second shoulder between said lowermost and intermediate portions, and a centerpost, said centerpost having a cylindrical body with upper and lower ends and a pair of identical, upstanding, spaced, diametrically opposed ears formed on said upper surface of said centerpost, said ears having free upper ends affixed to said first shoulder of said cap, said centerpost having an axial bore coaxial with said cylinder.

11. The regulator claimed in claim 10, wherein said stop means comprises a rim-like annular member having a central hub connected to said rim by a pair of diametric webs, said stop means being slidably mounted on said centerpost with said hub being received between said centerpost ears and within said centerpost bore and said webs being received between said centerpost ears.

12. The regulator claimed in claim 11, wherein said annular rim has an inside diameter corresponding to and slidable with respect to the diameter of said centerpost body, said centerpost body having an annular notch formed therein with an O-ring therein making an air-tight seal with said rim.

13. The regulator claimed in claim 12, wherein said rim has an outside diameter corresponding to and slidable with respect to said lowermost portion of said cap bore, said lowermost portion of said cap bore having an annular notch formed therein with an O-ring therein making an air-tight seal with said rim.

14. The regulator claimed in claim 13, said stop means hub having a threaded bore therein coaxial with said cylinder, wherein said means to shift said stop means comprises an adjustment screw, said adjustment screw having a main threaded body portion threadedly engaged in said stop means hub bore, said adjustment screw main body portion extending through said uppermost portion of said cap bore, said adjustment screw main body portion being surmounted by a neck portion of lesser diameter, said neck portion being surmounted by a head portion of a diameter greater than said neck portion, and a manual knob affixed to said head portion.

15. The regulator claimed in claim 14, wherein means mounted on the exterior of said cap to captively engage said adjustment screw neck portion permits rotation of said adjustment screw and precludes axial movement thereof.

16. The regulator claimed in claim 15, said stop means being shiftable by said adjustment screw toward and away from said cylinder between an uppermost position wherein said rim abuts said cap second shoulder and a lowermost position wherein said webs abut said top of said centerpost.

17. The regulator claimed in claim 16, wherein said main valve comprises an annular ring-like member, said main valve having an internal diameter substantially equal to the diameter of said centerpost and being slidably and guidably mounted on said centerpost, whereby means on said main valve forms an air-tight seal with said centerpost.

18. The regulator claimed in claim 17, wherein said housing adjacent said main valve has a cylindrical internal surface of a diameter corresponding to the external diameter of said main valve, said main valve peripheral surface having a sliding fit with said adjacent housing cylindrical internal surface and having a groove containing an O-ring making an air-tight seal therewith.

19. The regulator claimed in claim 18, said main valve having an annular notch formed in its periphery at the lowermost edge thereof, wherein a sealing gasket is mounted in said notch, said sealing gasket engaging said upper end of said cylinder when said main valve is in said closed position, said main valve abutting said stop rim when in its open position and whereby said adjustable stop means can adjust said annular opening and said tool power.

20. The regulator claimed in claim 19 including passage means connecting that portion of said cylinder above said piston/driver assembly to atmosphere, said main valve in said open position closing said passage means, said main valve in said closed position opening said passage means.

21. The regulator claimed in claim 19 wherein said means mounted on the exterior of said cap to captively engage said adjustment screw neck portion comprises a retainer plate having a longitudinally extending slot formed therein, said slot extending inwardly from an edge of said plate and terminating in a rounded end, said adjustment screw neck portion being rotatively engaged by said rounded slot end, said retainer plate being surmounted by cover plate having an opening therein through which said adjustment screw head portion extends, said cap, said retainer plate slot and said cover plate forming an air passage from said cap bore to atmosphere, a plurality of radial bores extending from said centerpost axial bore through the periphery of its cylindrical body, said radial bores and said axial bore of said centerpost, said cap bore and said air passage comprising a vent passage from that portion of said cylinder above said piston/driver assembly to atmosphere, said main valve having an inner annular surface, a groove formed in the upper portion of said inner surface containing a first O-ring making an air-tight seal with said periphery of said centerpost above said radial passages when said main valve is in both its open and closed positions, said main valve having a groove formed in the lower portion of its inner surface containing an O-ring making an air-tight seal with the periphery of said centerpost below said radial passages closing said vent passage when said main valve is in its open position.

22. The regulator claimed in claim 1 including passage means connecting that portion of said cylinder above said piston/driver assembly to atmosphere, said main valve in said open position closing said passage means, said main valve in said closed position opening said passage means.

* * * * *